US008144910B2

(12) United States Patent
Saltykov

(10) Patent No.: US 8,144,910 B2
(45) Date of Patent: Mar. 27, 2012

(54) COMPOSITE RECEIVER TUBE FOR A HEARING INSTRUMENT

(75) Inventor: Oleg Saltykov, Fairlawn, NJ (US)

(73) Assignee: Siemens Hearing Instruments, Inc., Piscataway, NJ (US)

( * ) Notice: Subject to any disclaimer, the term of this patent is extended or adjusted under 35 U.S.C. 154(b) by 1030 days.

(21) Appl. No.: 12/060,494

(22) Filed: Apr. 1, 2008

(65) Prior Publication Data

US 2009/0123015 A1 May 14, 2009

Related U.S. Application Data

(60) Provisional application No. 60/987,798, filed on Nov. 14, 2007.

(51) Int. Cl.
*H04R 25/00* (2006.01)

(52) U.S. Cl. ..... 381/328; 381/322; 381/324; 381/312

(58) Field of Classification Search ..... 381/328
See application file for complete search history.

(56) References Cited

U.S. PATENT DOCUMENTS

| | | | | | |
|---|---|---|---|---|---|
| 4,055,233 | A * | 10/1977 | Huntress | 181/135 |
| 5,411,467 | A * | 5/1995 | Hortmann et al. | 600/25 |
| 5,970,157 | A * | 10/1999 | Yoest | 381/325 |
| 5,982,908 | A * | 11/1999 | Bauman | 381/325 |
| 6,513,621 | B1 * | 2/2003 | Deslauriers et al. | 181/130 |
| 6,577,740 | B1 * | 6/2003 | Bordewijk | 381/323 |
| 6,744,897 | B1 * | 6/2004 | Vonlanthen | 381/322 |
| 7,043,037 | B2 * | 5/2006 | Lichtblau | 381/317 |
| 7,054,457 | B2 * | 5/2006 | Saltykov | 381/328 |
| 7,793,756 | B2 * | 9/2010 | Karamuk | 181/135 |
| 2003/0044037 | A1 * | 3/2003 | Park | 381/322 |
| 2004/0240694 | A1 * | 12/2004 | Wolf | 381/322 |
| 2005/0244026 | A1 * | 11/2005 | Nielsen et al. | 381/380 |
| 2006/0104467 | A1 * | 5/2006 | Aeschlimann et al. | 381/328 |
| 2006/0254851 | A1 * | 11/2006 | Karamuk | 181/135 |
| 2007/0223756 | A1 * | 9/2007 | Nielsen | 381/322 |
| 2008/0181440 | A1 * | 7/2008 | Saltykov | 381/328 |

* cited by examiner

*Primary Examiner* — Elvin G Enad
*Assistant Examiner* — Christopher Uhlir
(74) *Attorney, Agent, or Firm* — Francis G Montgomery

(57) ABSTRACT

The compliance of a receiver tube for a hearing instrument may be enhanced by fabricating it as a composite assembly of a tube and a compliant insulator positioned between the tube and the receiver. The material of the insulator is selected such that it has a greater compliance than that of the tube.

5 Claims, 4 Drawing Sheets

COMPOSITE RECEIVER TUBE FOR A HEARING INSTRUMENT

CROSS-REFERENCE TO RELATED APPLICATIONS

This application is related to and claims the benefit of commonly-owned U.S. Provisional Application for Patent, Ser. No. 60/987,798, filed Nov. 14, 2007, and is also related to commonly-owned U.S. patent applications Ser. No. 10/610,449, filed Jun. 30, 2003, and titled "Feedback Reducing Receiver Mount and Assembly," and Ser. No. 10/945,704, filed Sep. 21, 2004, and titled "Feedback Reducing Receiver Mount and Assembly," all incorporated herein by reference.

BACKGROUND AND SUMMARY OF THE INVENTION

A receiver tube for a hearing instrument receiver, the component that generates the sound heard by the user of the hearing instrument, connects the output of the receiver with the outside of the shell, conveying the sound from the receiver to the user's ear canal. To accommodate a wax guard and provide a secure attachment for the receiver, the receiver tube may be configured as a composite of a tube, a cup, an insulator, and a flange that mates with the receiver. An insulator fashioned from a compliant material minimizes vibration that may be induced into the shell by the action of the receiver.

DESCRIPTION OF THE INVENTION

Figure 1:
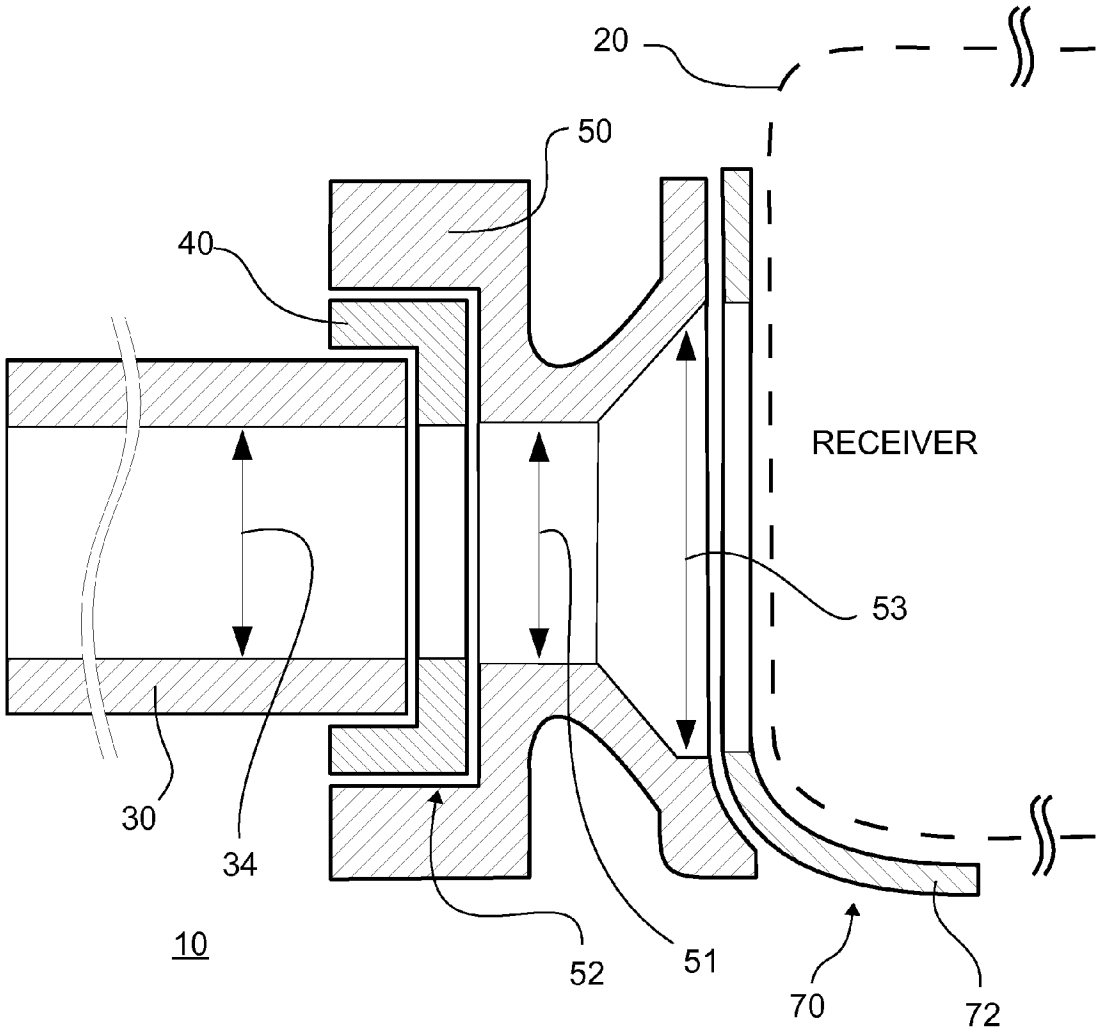
FIG. 1 is a cross-sectional view of a composite receiver tube.

A composite receiver tube 10 for a hearing instrument receiver 20, is shown in FIG. 1, with the receiver 20 drawn partially in phantom. The composite receiver tube 10 in FIG. 1 comprises four elements: a tube 30, a cup 40, an insulator 50, and a flange 70 that mates with the receiver 20. The cup 40 and the flange 70 help facilitate the manufacturing and assembly of the composite receiver tube, but may be omitted.

Figure 4:
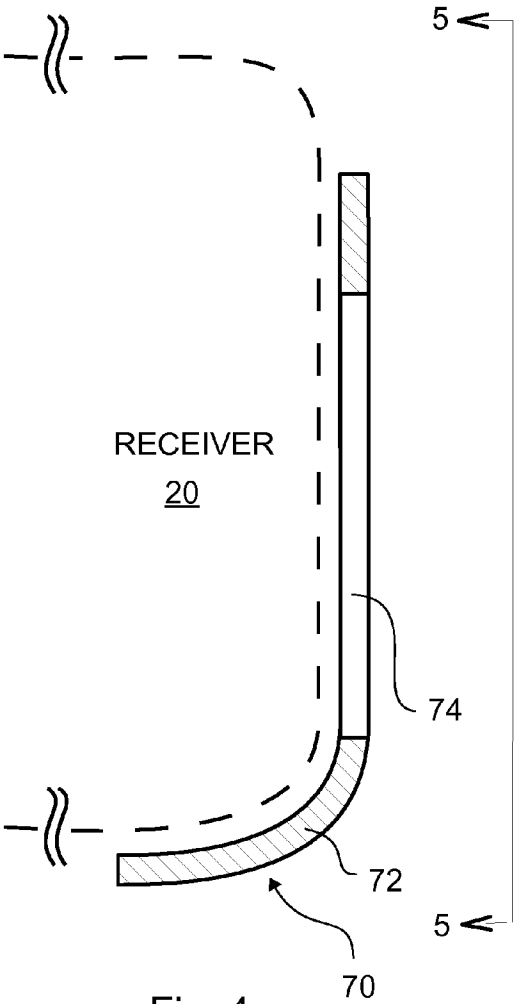

The tube 30, the cup 40, and the insulator 50 may have a circular cross section or a cross section of some other shape as desired. The flange 70 provides a physical or mounting interface between the insulator 50 and the receiver 20. As shown in FIGS. 1 and 4, the flange 70 may have an optional curved section 72 conforming to the receiver 20. The flange 70 may be secured to the receiver 20 with an adhesive or by spot-welding, or a combination of the two.

The tube 30 may be fabricated from a synthetic material such as an elastomer or any other suitable material. One such elastomer is marketed by DuPont Dow Elastomers, L.L.C. under the trademark Viton. A Viton elastomer having a hardness rating of 50 on the Shore A scale will be suitable.

The tube 30 resides in the cup 40, which in turn resides in a recess 52 in the insulator 50. The cup 40 may be fabricated from a metal such as steel or any other suitable material. As depicted here, the cup 40 and the conforming recess 52 are cylindrical, but they could easily assume a different shape. The tube 30 may be secured to the cup 40 with an adhesive.

Figure 3:
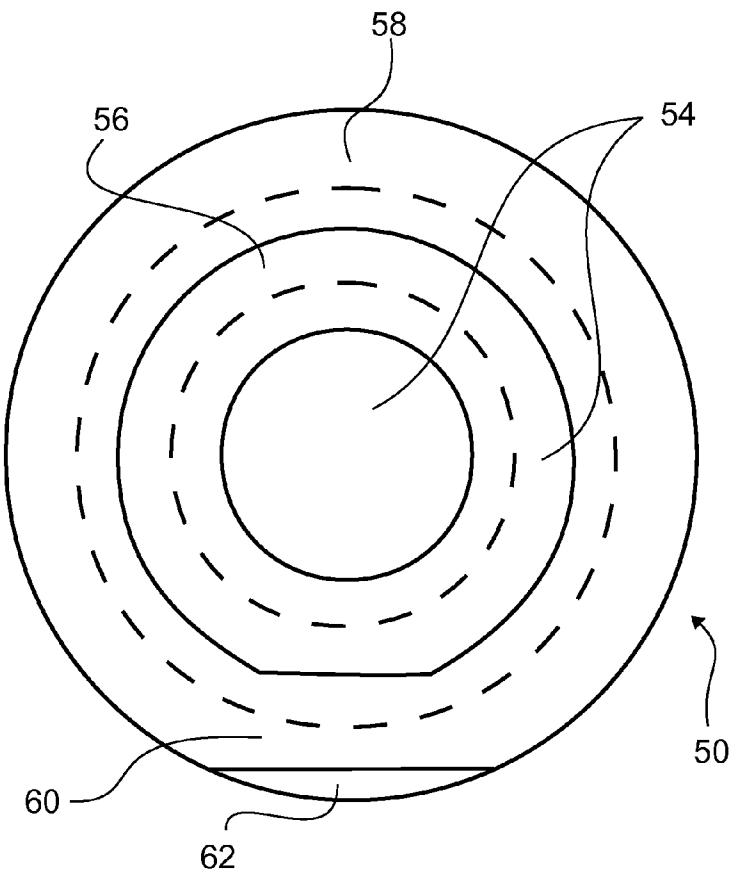
FIGS. 2 and 3 are drawings of an insulator for a composite receiver tube.
Figure 2:
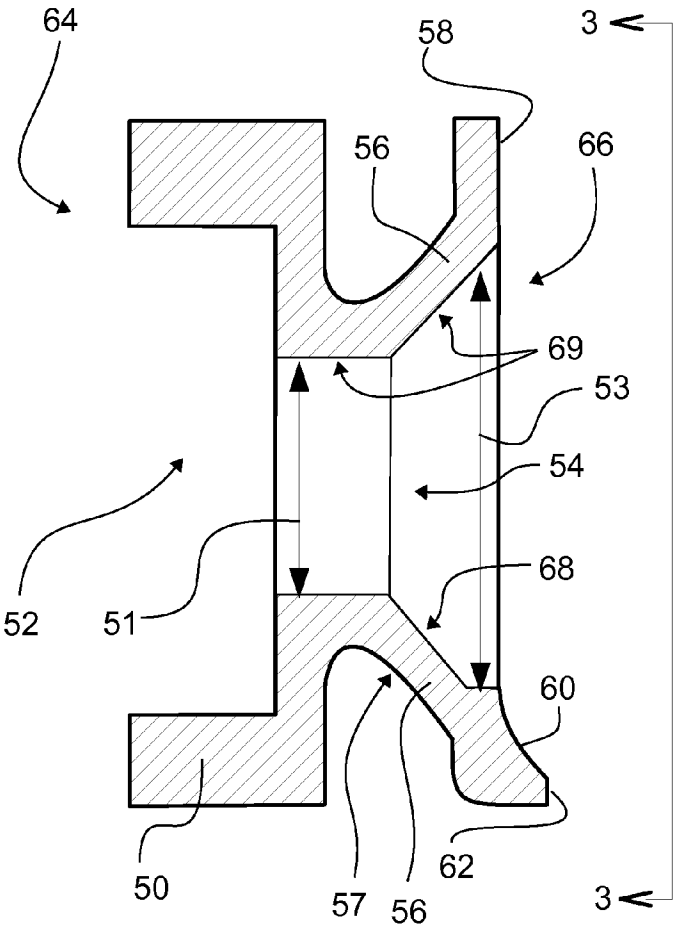

In addition to the recess 52 for the cup 40, the insulator 50 comprises an inner surface 69 comprising an internal sound channel 54 extending from the tube side 64 of the insulator 50 to the receiver side 66 of the insulator 50 (FIG. 2). As illustrated in FIGS. 2 and 3, the insulator 50 comprises an outer surface 57 comprising a flared section 56 that widens out towards the flange 70 (FIG. 1). The flared section 56 reduces the rigidity of the insulator 50 and increases the compliance of the insulator 50. The flared section 56 may assume a variety of shapes, including conical, hyperboloidal (technically, one half of a hyperboloid), and paraboloidal. As can be seen in FIG. 2, the portion of the sound channel 54 within the flared section 56 and adjacent the receiver side 66 of the insulator 50 comprises a flared, inner contour 68 having a shape comparable to the shape of the flared outer surface 57, that widens to the wide, inner dimension 53. Further, as shown in FIGS. 1 and 2, the portion of the internal sound channel 54 near the tube side 64 of the insulator 50 comprises a narrow, inner dimension 51 approximately equal to the inner dimension 34 of the tube 30.

Figure 5:
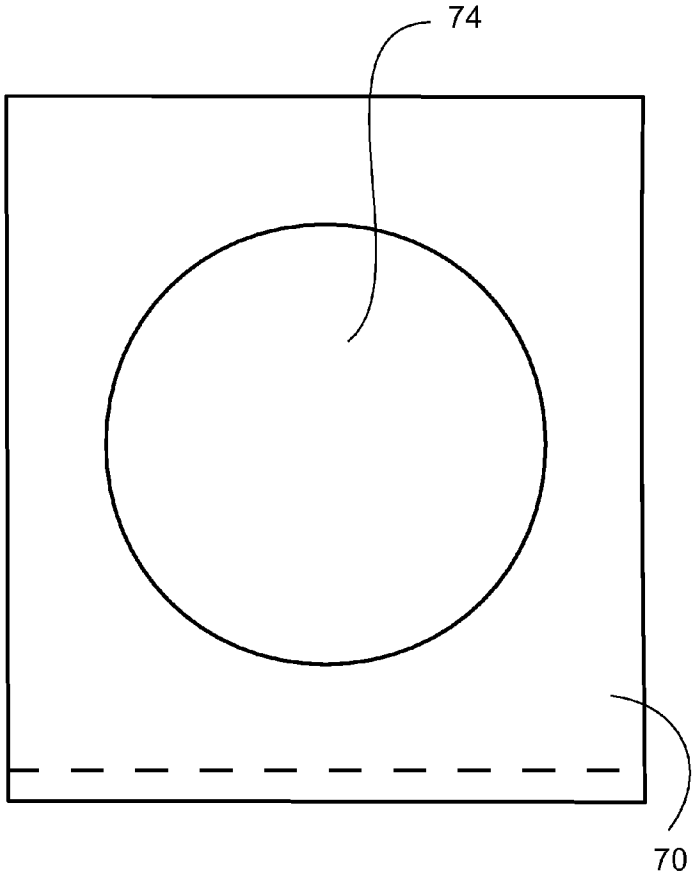
FIGS. 4 and 5 are drawings of a flange for a composite receiver tube.

A facing 58 on the flared section 56 (FIGS. 2 and 3) provides a surface which mates with the flange 70. The facing 58 may have a curved surface 60 that conforms to the curved section 72 of the flange 70 (FIG. 4), terminating in a lip 62. An opening 74 in the flange 70 (FIGS. 4 and 5) connects the sound channel 54 of the insulator 50 with the opening (not shown) of the receiver 20.

The insulator 50 may be fabricated in an injection-molding process, incorporating the cup 40 and the flange 70 during the process as appropriate. The insulator 50 may be made from a soft, rubber-like material such as a fluorosilicone having a hardness rating of 20-30 on the Shore A scale. Compared to the tube 30, the insulator 50 exhibits greater compliance. As noted above, the compliant effect of the insulator 50 is further enhanced by the flared section 56.

If desired, the tube side 64 of the insulator 50 could be connected directly to tube 30 while the receiver side 66 of the insulator 50 could be affixed directly to the receiver 20, foregoing the cup 40 and the flange 70, respectively. Where the cup 40 is omitted, the recess 52 on the tube side 64 of the insulator 50 may be sized to the outer dimensions of the tube 30.

Figure 6:
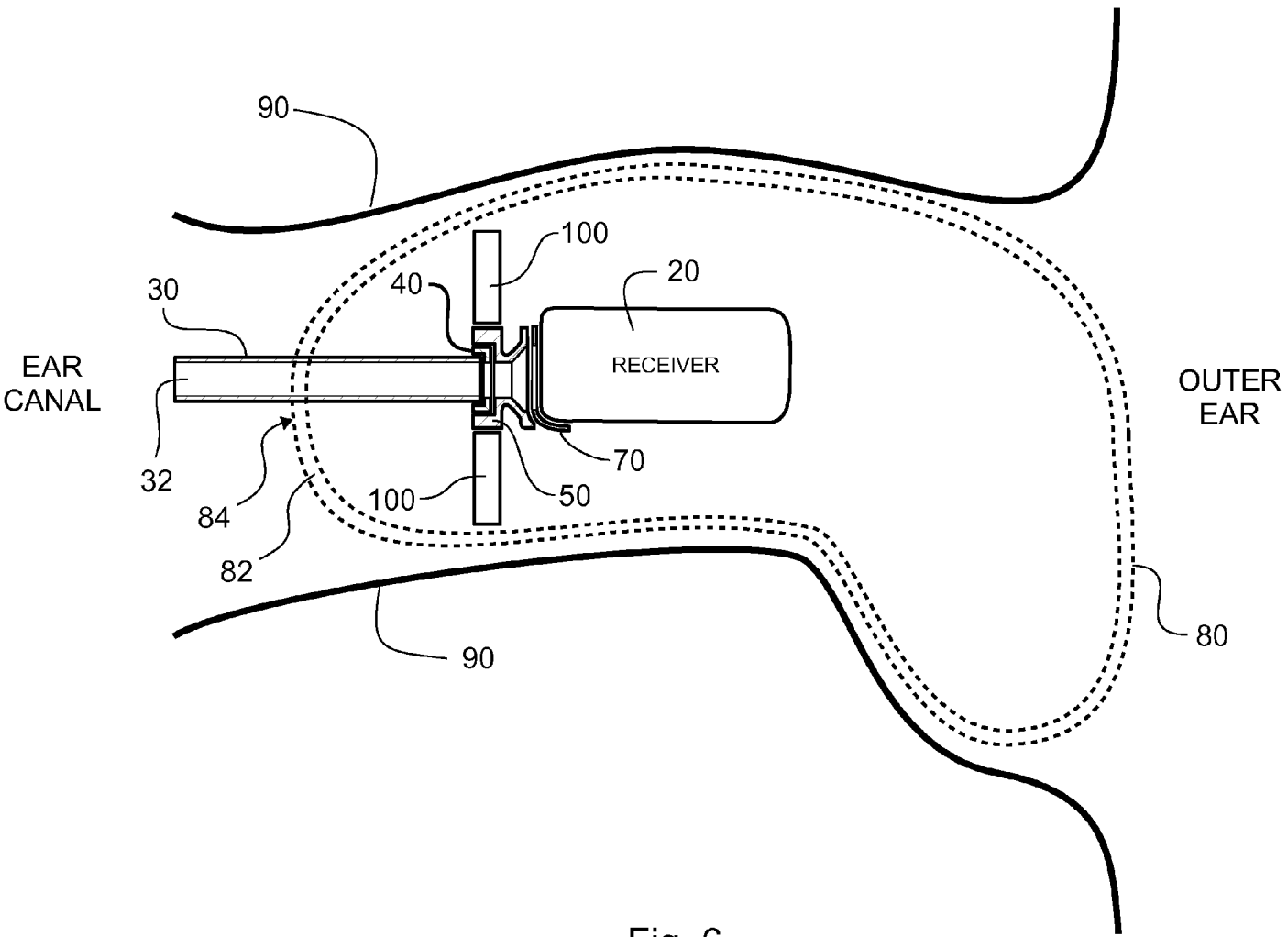
FIG. 6 illustrates a composite receiver tube within a shell residing in the ear canal of the user.

The composite receiver tube 10 and the receiver 20 are shown within a shell 80 (shown in phantom), residing in the user's ear canal 90 in FIG. 6. The tube 30 passes through the wall 82 of the shell 80. Optional mounting brackets 100, anchored within the shell 80 and attached to the insulator 50, and supporting the composite receiver tube 10 within the shell 80, are illustrated schematically. After the composite receiver tube 10 has been installed in the shell 80, the end 32 of the tube 30 protruding from the shell 80 is typically trimmed flush with the outer surface 84 of the shell 80.

What is claimed is:

1. A composite receiver tube for conveying the output of a hearing instrument receiver in a hearing instrument to a user's ear canal, the hearing instrument comprising a shell, the shell comprising a wall, comprising:

a tube connected to the user's ear canal, the tube passing through the wall of the shell; and an insulator positioned between the tube and the receiver, the insulator comprising a surface for mating with the tube;

a surface for mating with the receiver;

an outer surface between the surface for mating with the tube and the surface for mating with the receiver, and comprising a flared section adjacent the surface for mating with the receiver that widens towards the surface for mating with the receiver; and an internal surface comprising an internal sound channel connecting the tube with the receiver, the internal sound channel extending from the surface for mating with the tube to the surface for mating with the receiver and comprising a narrow, inner dimension adjacent the surface for mating with the tube;

a wider, inner dimension adjacent the surface for mating with the receiver; and a flared, inner contour adjacent and widening towards the surface for mating with the receiver.

2. A composite receiver tube as set forth in claim 1, where the insulator comprises material exhibiting a greater compliance than the compliance of the tube.

3. A composite receiver tube as set forth in claim 1, where the flared section comprises inner and outer conical, half-hyperboloidal, or paraboloidal shapes.

4. A composite receiver tube as set forth in claim 1, further comprising a flange positioned between the insulator and the receiver, on the surface for mating with the receiver, where the flange comprises an opening connecting the sound channel of the insulator with the receiver.

5. A composite receiver tube as set forth in claim 1, where the surface for mating with the tube comprises a recess and the insulator further comprises a cup positioned in the recess, where the cup receives the tube.

* * * * *